US008276797B2

(12) United States Patent
Dwyer et al.

(10) Patent No.: US 8,276,797 B2
(45) Date of Patent: Oct. 2, 2012

(54) PREMIUM SEPARATOR WITH CONTOURED SPACED-APART BELT

(75) Inventors: Jeffrey Dwyer, Naperville, IL (US); Andrew Yount, Lombard, IL (US)

(73) Assignee: Insight Promotions, LLC, Bartlett, IL (US)

( * ) Notice: Subject to any disclaimer, the term of this patent is extended or adjusted under 35 U.S.C. 154(b) by 455 days.

(21) Appl. No.: 12/554,054

(22) Filed: Sep. 4, 2009

(65) Prior Publication Data

US 2011/0057011 A1 Mar. 10, 2011

(51) Int. Cl.
*B26F 3/02* (2006.01)

(52) U.S. Cl. ..... 225/100; 225/106; 225/93

(58) Field of Classification Search ..... 83/698.91, 83/595, 341, 611, 694, 614; 225/100, 93, 225/94, 95, 97, 103–106; 226/168–194; 221/25; 53/403, 79

See application file for complete search history.

(56) References Cited

U.S. PATENT DOCUMENTS 3,660,189 A * 5/1972 Troy ..... 156/145
3,895,751 A 7/1975 Shepherd
3,984,030 A 10/1976 Morini
3,999,694 A 12/1976 Vossen
4,069,957 A 1/1978 Moffitt
4,215,626 A 8/1980 Giulianotto
4,261,497 A 4/1981 Roetter et al.
4,454,973 A 6/1984 Irvine
4,498,894 A * 2/1985 Kuckhermann ..... 493/234
4,874,194 A 10/1989 Borcea et al.
4,997,119 A 3/1991 Meschi
5,079,901 A 1/1992 Kotsiopoulos
5,090,591 A 2/1992 Long
5,230,453 A 7/1993 Meschi
5,239,809 A * 8/1993 Long ..... 53/513
5,297,711 A 3/1994 Kogan
5,320,341 A 6/1994 Pease et al.
5,427,294 A 6/1995 VandenHeuvel et al.
5,501,064 A 3/1996 Ingram et al.
5,549,233 A 8/1996 Clauser
5,588,280 A 12/1996 Kotsiopoulos
5,752,365 A 5/1998 Johnson et al.
5,784,861 A 7/1998 Kotsiopoulos
5,785,224 A 7/1998 Nowakowski
5,794,406 A * 8/1998 Reichental et al. ..... 53/410
5,803,261 A 9/1998 Nowakowski et al.
5,845,462 A 12/1998 Kuehl et al.
5,865,358 A 2/1999 Fernandez
5,941,053 A 8/1999 Kotsiopoulos
5,941,054 A 8/1999 Valyi
5,966,906 A 10/1999 Kuehl et al.
6,035,610 A 3/2000 Vonderhorst et al.
6,082,079 A 7/2000 Kuehl et al.
6,251,450 B1 6/2001 Giacoman
6,257,475 B1 7/2001 Ishii et al.
(Continued)

*Primary Examiner* — Laura M. Lee
(74) *Attorney, Agent, or Firm* — Momkus McCluskey, LLC; Jefferson Perkins

(57) ABSTRACT

Apparatus for separating a fragile, packaged premium from a bandolier of packaged premiums includes a number of gripping pairs disposed along an axis of travel. The gripping pairs are designed to grip the premium packaging at pre-defined grip zones along the peripheral edges of the wrapper without clamping onto the premium-containing portion of the package. Preferably, the gripping pairs are sets of endless tracks that are beveled away from the contact surface of each tread such that the beveled surfaces are superimposed on a marginal portion of the premium-containing zone so as to assist in centering the bandolier on the axis of travel.

8 Claims, 5 Drawing Sheets

U.S. PATENT DOCUMENTS

| | | | | |
|---|---|---|---|---|
| 6,485,285 | B1 | 11/2002 | Shiotani | |
| 6,599,384 | B2 | 7/2003 | Milner et al. | |
| 6,625,956 | B1 * | 9/2003 | Soudan | 53/455 |
| 6,722,108 | B1 | 4/2004 | Kotsiopoulos | |
| 6,725,628 | B2 | 4/2004 | Lohrey et al. | |
| 6,751,935 | B2 | 6/2004 | Brenkus | |
| 6,835,042 | B2 | 12/2004 | de Koning | |
| 7,032,774 | B2 | 4/2006 | Boehm et al. | |
| 7,370,783 | B2 | 5/2008 | Hubrecht | |
| 2001/0000612 | A1 | 5/2001 | Nowakowski | |
| 2003/0070401 | A1 | 4/2003 | Brenkus | |
| 2004/0028864 | A1 | 2/2004 | Nelson | |
| 2004/0149767 | A1 | 8/2004 | Boehm et al. | |
| 2004/0250514 | A1 | 12/2004 | Brenkus | |
| 2006/0010835 | A1 * | 1/2006 | Shaw et al. | 53/403 |
| 2008/0098696 | A1 | 5/2008 | Gallimore | |
| 2008/0098697 | A1 | 5/2008 | Murray | |
| 2008/0289301 | A1 | 11/2008 | Gallimore | |
| 2009/0005203 | A1 | 1/2009 | Nowakowski et al. | |

* cited by examiner

PREMIUM SEPARATOR WITH CONTOURED SPACED-APART BELT

BACKGROUND OF THE INVENTION

Packaged goods, such as boxes of cereal, often have a premium or prize inserted in them. These premiums or prizes typically are provided in a bandolier of serial packages, each package containing one such prize and being separated from adjacent packages by a seam or seal. Apparatus has been developed to automatically separate one packaged premium from a bandolier of such premiums and to insert the premium into the larger package of goods.

Interest in such inserted premiums has increased because they can be a very effective, targeted form of marketing. A sample inserted into a larger package or box of goods bought by a consumer has no extra distribution cost, has typically negligible additional weight and is highly targeted at a group of consumers which the marketer is trying to reach: consumers who have actually made a decision to buy a related product.

Conventional apparatus for doing this have placed limitations on the kinds of premiums which can be inserted. They generally have to be tough enough to withstand the insertion apparatus. Where a premium takes the form of a paper coupon or other flat medium, a bandolier of such coupons can pass through sets of rollers and the coupons are separated by lines of perforations. To separate a coupon from the bandolier, one set of rollers stops while another adjacent set keeps going, having the effect of putting tension on a perforation line and bursting the coupon along the perforation line from the rest of the bandolier. U.S. Pat. No. 6,722,108 issued to Kotsiopoulos describes this kind of typical insertion apparatus. Burst-roller coupon inserters of this type would, however, simply smash a fragile packaged premium.

In some cases, it is desirable to include fragile premium items such as plastic toys, baked items such as a pretzels or cookies, or candy which may be damaged by the conventional apparatus. Friction rollers, however, would simply smash these fragile packaged premiums to such an extent that the premium will be rendered unacceptable. As a result, if these items are to be included, they would have to be inserted manually, which can be quite expensive and time consuming. Thus, a need persists in developing premium separators and inserters which will place a minimum amount of stress on the packaged premium and deliver it to the point of insertion in an undamaged condition.

SUMMARY OF THE INVENTION

According to one aspect of the invention, apparatus is provided for separating a packaged premium from a bandolier of packaged premiums in which the bandolier has a wrapper with wakened separation lines delimiting each packaged premium from adjacent ones of the packaged premiums, a first grip zone along a first longitudinal peripheral edge of the wrapper and a second grip zone along a second longitudinal peripheral edge of the wrapper opposite the first peripheral edge, the grip zones each having top and bottom surfaces and being space apart from each other by a premium-containing zone. The apparatus at least have left upstream gripping pairs disposed along an axis of travel parallel to the first grip zone, right upstream gripping pairs, and left and right downstream gripping pairs.

The left upstream gripping pair comprises an upper left upstream gripping member having an upper left upstream contact surface and is adaptable to assume an engaged position and a lower left upstream gripping member having a lower left upstream contact surface which is adaptable to assume an engaged position. A portion of the first grip zone is clamped between the upper left upstream contact surface and lower left upstream contact surface when they are in the engaged position, but the left upstream gripping pair does not clamp to the premium-containing zone of the bandolier.

The right upstream gripping pair comprises a lower right upstream gripping member and an upper right upstream gripping member with an upper right upstream contact surface and also is adaptable to assume an engaged position. The lower right upstream gripping member has a lower right upstream contact surface and is adaptable to assume an engaged position. A portion of the second grip zone is clamped between the upper right upstream contact surface and the lower right upstream contact surface when they are in the engaged position, but the right upstream gripping pair does not clamp to the premium-containing zone of the bandolier.

Each left downstream gripping pair comprises an upper left downstream gripping member having an upper left downstream contact surface which is adaptable to assume an engaged position and a lower left downstream gripping member having a lower left downstream contact surface. The lower left downstream gripping member is adaptable to assume an engaged position, with a portion of the first grip zone clamped between the upper left downstream contact surface and lower left downstream contact surface when they are in the engaged position. The left downstream gripping pair does not clamp to the premium-containing zone of the bandolier.

Each right downstream gripping pair comprises an upper right downstream gripping member having an upper right downstream contact surface and being adaptable to assume an engaged position and a lower right downstream gripping member. The lower right downstream gripping member has a lower right downstream contact surface and is adaptable to assume an engaged position, with a portion of the second grip zone clamped between the upper right downstream contact surface and the lower right downstream contact surface when they are in the engaged position. The right downstream gripping pair does not clamp to the premium-containing zone of the bandolier.

Additionally, the apparatus comprises a first drive mechanism that is coupled to the upstream gripping pairs and is selectively actuable to translate the upstream gripping pairs in a downstream direction parallel to the axis of travel. A second drive mechanism is coupled to the downstream gripping pairs for translating the downstream gripping pairs in a downstream direction. The upstream gripping pairs are translated by the first drive mechanism at a speed which is at least intermittently slower than the speed of the downstream translation of the downstream pairs by the second drive mechanism, thereby causing separation of a downstream packaged premium from the bandolier along a wakened separation line. It is preferred that the gripping pairs take the form of treads on opposed endless tracks.

In another embodiment of the invention, apparatus is provided for separating a packaged premium from a bandolier of packaged premiums, the bandolier comprising a wrapper with wakened separation lines delimiting each packaged premium from adjacent ones of the packaged premiums, a first grip zone along a first longitudinal peripheral edge of the wrapper, and a premium-containing zone. The apparatus comprises an upper left upstream endless track disposed along an axis of travel parallel to the first grip zone. The first grip zone comprises a plurality of upper left upstream movable treads, with each tread having an upper left upstream contact surface for engaging a first area of the first grip zone and being adaptable to move in a downstream direction while in contact with the first area of the first grip zone.

The apparatus further comprises a lower left upstream endless track disposed along the axis of travel comprising a plurality of lower left upstream movable treads, each tread having a lower left upstream contact surface for engaging the first area of the first grip zone against the upper left upstream contact surface but not clamping the premium-containing zone. Further, each tread is adaptable to move in a downstream direction while in contact with the first area of the first grip zone.

The apparatus further comprises an upper left downstream endless track disposed along the axis of travel comprising a plurality of upper left downstream movable treads, each tread having an upper left downstream contact surface for engaging a second area of the first grip zone. Each tread is adaptable to move in a downstream direction while in contact with the second area of the first grip zone. Additionally, a lower left downstream endless track is disposed along the axis of travel and comprises a plurality of lower left downstream movable treads, with each tread having a lower left downstream contact surface for engaging the second area of the first grip zone against the upper left downstream contact surface but not clamping the premium-containing zone. Each tread is adaptable to move in a downstream direction while in contact with the second area of the first grip zone.

A first drive mechanism is coupled to at least one of the upper left upstream track and the lower left upstream endless track and is selectively actuable to translate the treads in a downstream direction parallel to the axis of travel. A second drive mechanism is coupled to at least one of the upper left downstream track and the lower left downstream endless track and is selectively actuable to translate the treads in a downstream direction parallel to the axis of travel. The speed of the upstream tracks is at least intermittently different from the speed of the downstream tracks so as to separate a first packaged premium from the bandolier.

The invention has the advantage of being able to move and separate fragile and three dimensional premiums without crushing or breaking them. Additionally, since the gripping pairs or tracks grip only the sides of the packaging, they produce a gradual edge-to-center tearing that reduces the shock and acceleration during the separation of the premium packages from the bandolier.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
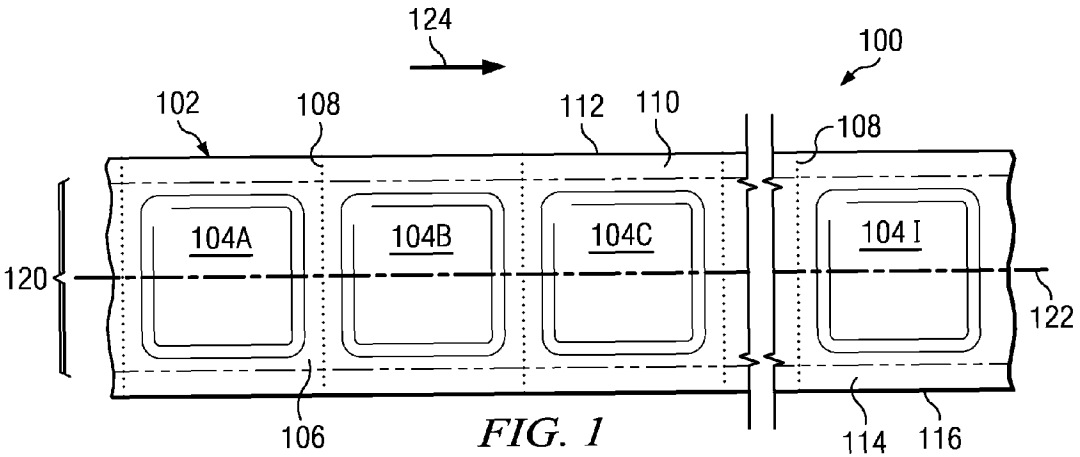
FIG. 1 (PRIOR ART)
FIG. 1 is a top view of a bandolier of packaged premiums showing the grip zones, the wakened separation lines, and the premium-containing zone.
Figure 4:
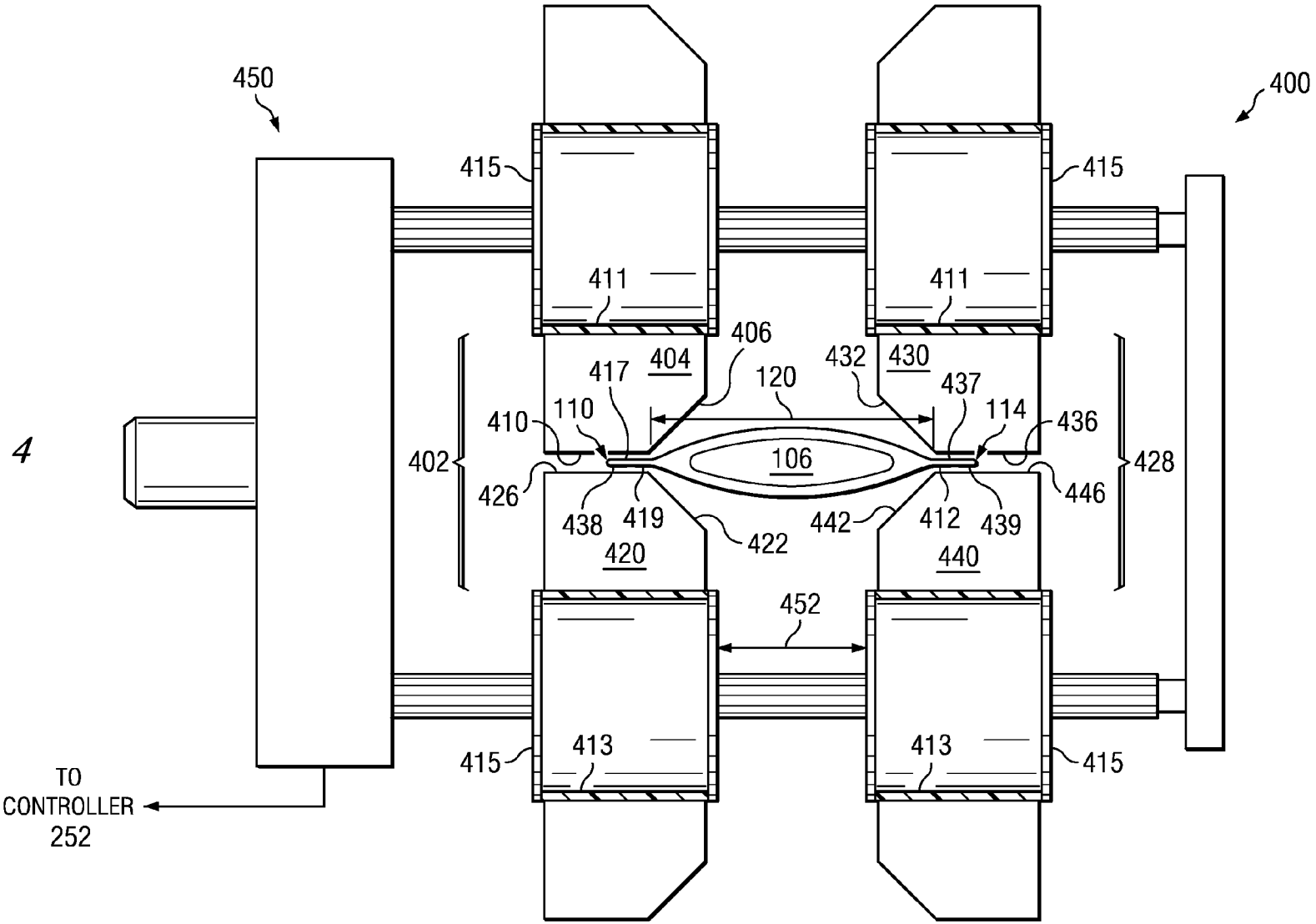
FIG. 4 is a cross sectional view of upper and lower downstream gripping pairs and a packaged premium showing the various surfaces of the pair.

The present invention relates to apparatus for separating a packaged premium from a bandolier of packaged premiums. Referring to FIG. 1, the bandolier 102 comprises a wrapper 106 with wakened separation lines 108 that delimit each packaged premium 104A-104I from the adjacent packaged premiums, a first grip zone 110 along a first longitudinal peripheral edge 112 of the wrapper 106 and a second grip zone 114 along a second longitudinal peripheral edge 116 of the wrapper 106 that is opposite the first peripheral edge 112. As can be seen in FIG. 4, each grip zone 110, 114 has a top surface 417, 437 and a bottom surface 419, 439 and the first and second grip zones 110, 114 are spaced apart from each other by a premium-containing zone 120.

Figure 2A:
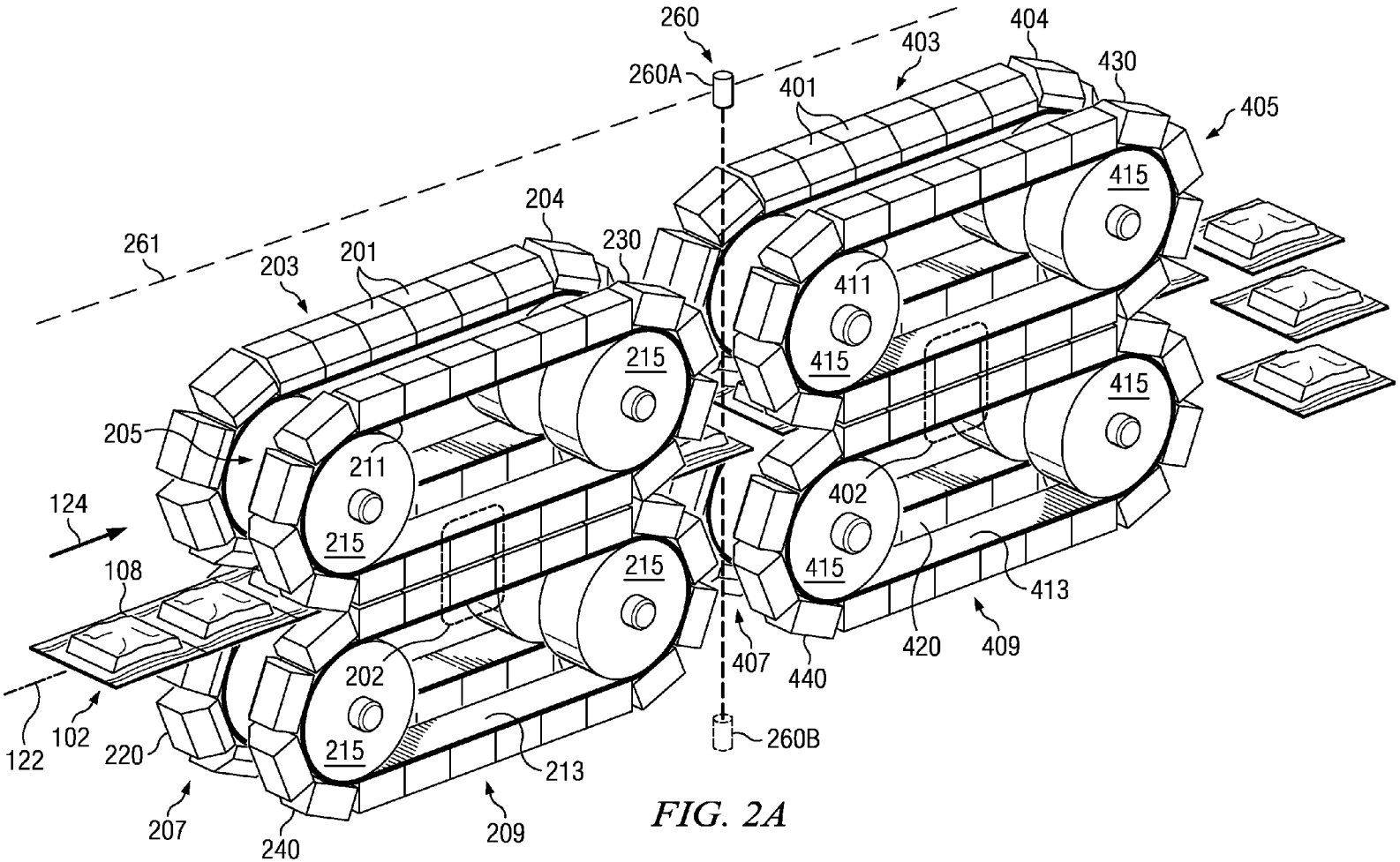
FIG. 2A is an isometric view according to one embodiment of the invention showing endless belts having numerous treads that grip the bandolier.
Figure 2B:
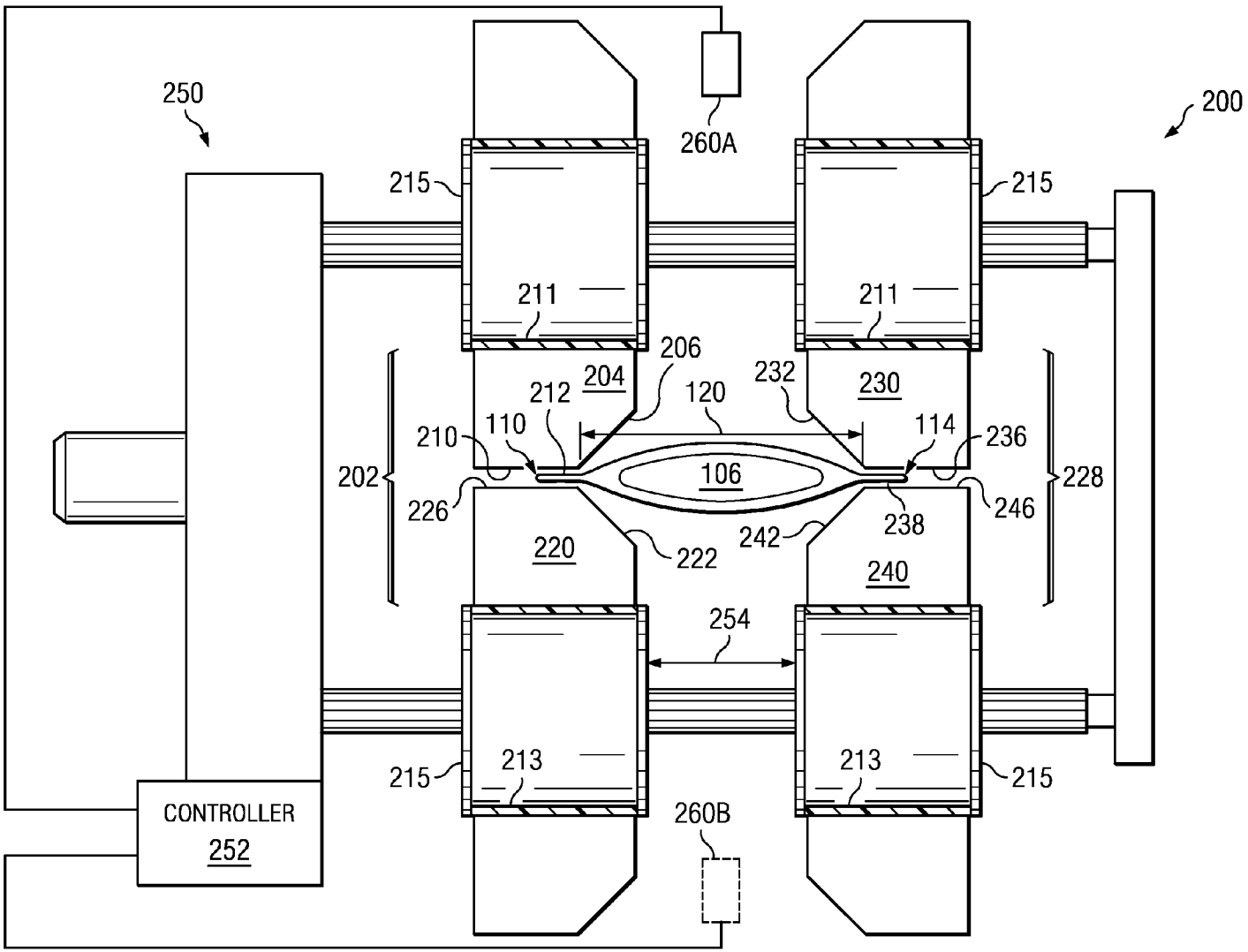
FIG. 2B is a cross sectional view of upper and lower upstream gripping pairs and a packaged premium, showing the various surfaces of the gripping pairs.

Referring to FIGS. 2A and 2B, the apparatus, indicated generally at 200, comprises opposing sets of gripping members, preferably treads on endless tracks 203, 207; 205, 209; 403, 407; and 405, 409. The opposed sets of gripping members form gripping pairs 202, 402 and each track has a plurality of movable treads 201, 401 on an endless belt 211, 213, 411, and 413 that act as the gripping pairs. The treads 201, 401 are adaptable to move in a downstream direction 124 while in contact with the respective area of the grip zone 110, 114.

Stated more generally, a plurality of left upstream gripping pairs 202, is disposed along an axis of travel 122 that is parallel to the first grip zone 110. As best seen in FIG. 2B, each left upstream gripping pair 202 comprises an upper left upstream gripping member 204 having an upper left upstream contact surface 210 and is adaptable to assume an engaged position. The identified gripping pairs 202, 228 shown in FIG. 2B are in an engaged position. Other gripping pairs, which are preferably other opposed treads on the upper and lower belts 211, 213, 411, and 413, are disengaged. A lower left upstream gripping member 220 has a lower left upstream contact surface 226 and is shown in an engaged position, a first area 212 of the first grip zone 110 being clamped between the upper left upstream contact surface 210 and lower left upstream contact surface 226. The left upstream gripping pair 202 does not clamp to the premium-containing zone 120 of the bandolier 102.

At least one right upstream gripping pair 228 is disposed along the axis of travel 122, each right upstream gripping pair 228 having an upper right upstream gripping member 230 having an upper right upstream contact surface 236. A lower right upstream gripping member 240 has a lower right upstream contact surface 246. FIG. 2B shows gripping members 236 and 240 in an engaged position. A first area 238 of the second bandolier grip zone 114 is clamped between the upper right upstream contact surface 236 and the lower right upstream contact surface 246 when they are in the engaged position. The right upstream gripping pair 228 does not clamp to the premium-containing zone 120 of the bandolier 102. In contrast to traditional rollers, the gripping pairs 202, 228 of a preferred embodiment of the invention support and carry the package along the axis of travel 122 by maintaining constant contact with the grip zones 110, 114 through an extended degree of displacement along axis 122. This is an advantage over traditional rollers which only momentarily engage the packaging and, therefore, allow the packaging to slip laterally inward toward the center of the packages due to the weight of the premium 104. The constant contact of the gripping members of the present invention does not allow the packages to slip laterally inwardly.

Referring to FIG. 4, at least one left downstream gripping pair 402 is disposed along the axis of travel 122 and comprises an upper left downstream gripping member 404 having an upper left downstream contact surface 410. A lower left downstream gripping member 420 has a lower left downstream contact surface 426. When surfaces 410 and 426 are in an opposed, engaged position as shown, they clamp a second area 438 of the first grip zone 110. The left downstream gripping pair 402 does not clamp to the premium-containing zone 120 of the bandolier 102.

At least one right downstream gripping pair 428 is disposed along the axis of travel 122 and comprises an upper right downstream gripping member 430 that has an upper right downstream contact surface 436. A lower right downstream gripping member 440 has a lower right downstream contact surface 440. When surfaces 436, 440 are in an opposed, engaged position, they clamp a second area 412 of the second grip zone 114. The right downstream gripping pair 428 does not clamp to the premium-containing zone 120 of the bandolier 102. As above, the downstream gripping pairs support and carry the packages along the axis of travel 122 by maintaining constant contact with the grip zones 110, 114.

Figure 5:
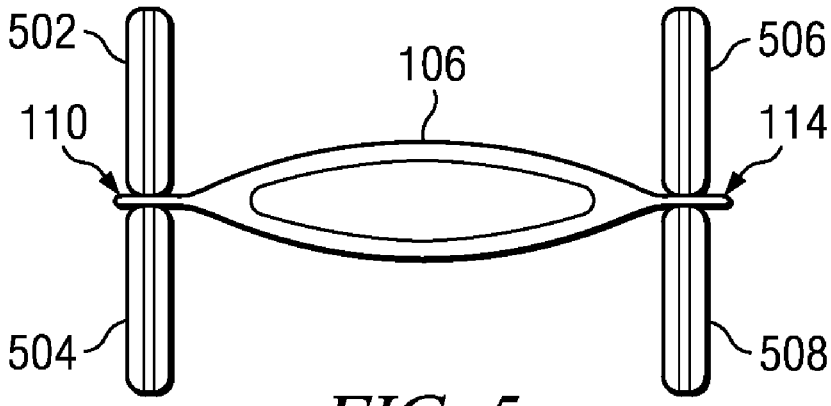
FIG. 5 is a cross sectional view of upper and lower gripping pairs according to a second embodiment of the invention where the gripping pairs are wheels.

As shown in FIG. 5, each gripping pair may, alternatively, consist of an upper left wheel 502, a lower left wheel 504, or an upper right wheel 506 and a lower right wheel 508, that respectively clamp the grip zones 110, 114.

As shown in FIGS. 2A, 2B, and 4, a first drive mechanism 250 is coupled to the belts 211, 213 and the upstream gripping pairs 202, 228 through pulleys 215 and is selectively actuable to translate the upstream gripping pairs 202, 228 in a downstream direction 124 parallel to the axis of travel 122. A second drive mechanism 450 is coupled to the belts 411, 413 and downstream gripping pairs 402, 428 through pulleys 415. The second drive mechanism 450 is actuable to translate the downstream gripping pairs 402, 428 in the downstream direction 124. The upstream gripping pairs 202, 228 are translated downstream by the first drive mechanism 250 at a speed which is at least intermittently slower than the speed of the downstream translation of the downstream pairs 402, 428 by the second drive mechanism 450. This causes separation of a downstream packaged premium from the bandolier along a wakened separation line 108. The first and second drive mechanisms 250, 450 may be shafts, tubes, chains, or belts and a controller 252 may be coupled to the first and second drive mechanisms 250, 252. In a preferred embodiment, in which the gripping pairs are constituted by opposed belts 211, 213, and 411, 413, the drive mechanism 250 is actuable to drive the belts around rollers 215, 415 at a programmably variable speed.

Figure 3:
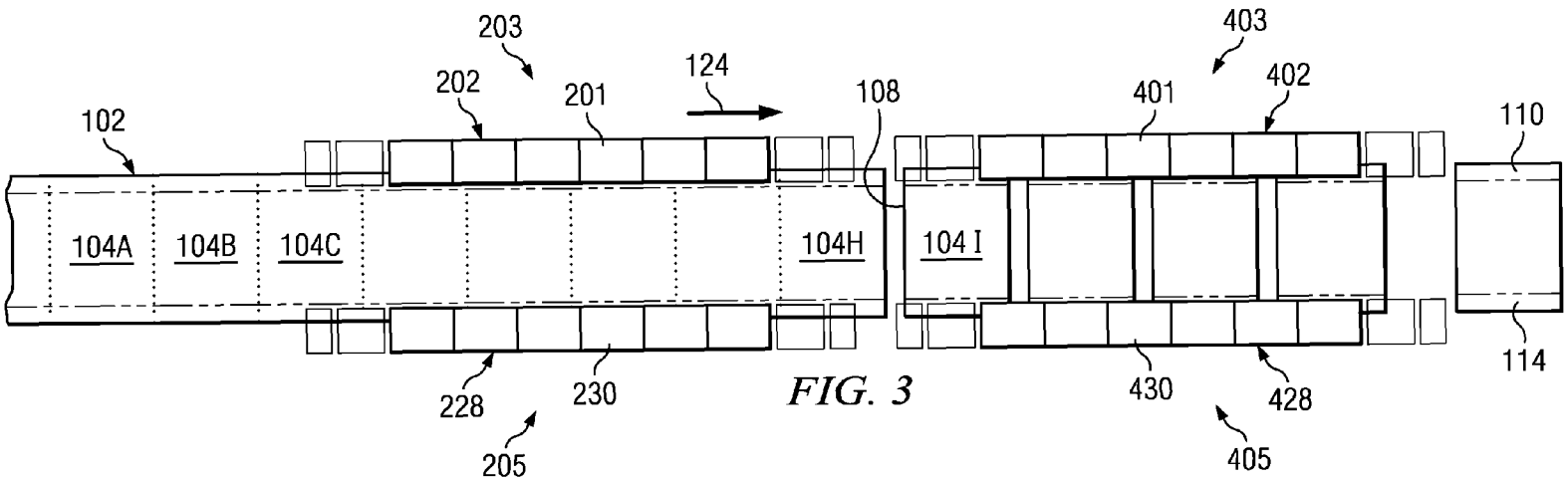
FIG. 3 is a top view of an apparatus according to one embodiment of the invention where the gripping pairs are endless tracks and the packages of the premiums are being separated from the bandolier.
Figure 6:
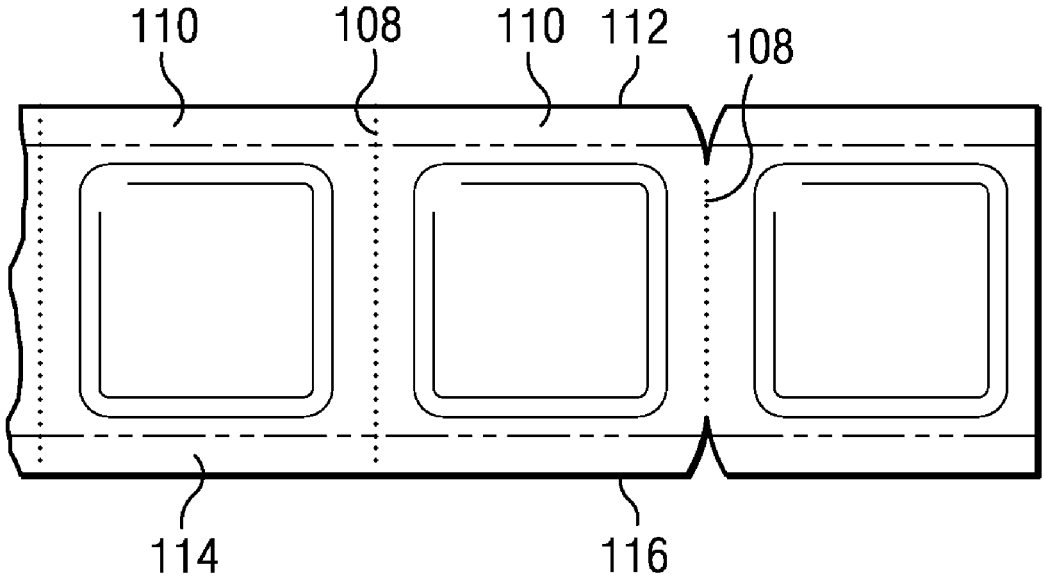
FIG. 6 is a top view of a bandolier of packaged premiums tearing from the first longitudinal edge and the second longitudinal edge towards the center along a wakened separation line.

The controller 252 can be adapted to halt the first drive mechanism 250 while the second drive mechanism 450 continues to translate the downstream gripping pairs 402, 428 in a downstream direction. This separation technique is illustrated generally at FIG. 3. This causes a separation of a first packaged premium 1041 from the bandolier 102 along a wakened separation line 108. Alternatively, the controller 252 is adapted to actuate the first drive mechanism 250 at a first speed and the second drive mechanism 450 at a second, faster speed. More preferably, the separation is a gradual tearing from the first longitudinal edge 112 and from the second longitudinal edge 116 towards the center of the wakened separation line 108, as illustrated in FIG. 6. This gradual tearing from the longitudinal edges 112, 116 is not the same as the traditional technique of "bursting" as it has come to be known in the art. The gradual tearing has the advantage of providing a more predictable, uniform separation than the bursting method. The bursting method produces a sharp pulling motion across the entire width of the packaging, resulting in a high tension load within a very short period of time. Such high loads can result in rapid acceleration that damages or destroys premium items such as baked goods and disappoints the consumer. Additionally, high stress loads can cause tearing of the packaging at places other than the wakened separation lines 108, nonuniform separated packages, and malfunctions of the insertion process. The gradual tearing method is more likely to tear along the wakened separation line and is, therefore, more reliable.

Referring to FIGS. 2B and 4, the apparatus has a first space 254 between the upstream gripping pairs 202, 228 and a second space 452 between the downstream gripping pairs 402, 428. Each of the spaces 254, 452 are laterally adjustable in a direction that is orthogonal to the axis of travel 122 so that the upstream gripping pairs 202, 228 and the downstream gripping pairs 402, 428 can accommodate bandoliers 102 having a range of widths.

In a preferred embodiment, the apparatus further comprises an upper left upstream interior surface 206 of the upper left upstream gripping member 204 that is proximate to the first grip zone 110 when it is in an engaged position. The upper left upstream interior surface 206 is beveled upwardly and laterally inwardly from the upper left upstream contact surface 210. A lower left upstream interior surface 222 of the lower left upstream gripping member 220 is proximate to the first grip zone 110 and is beveled downwardly and laterally inwardly from the lower left upstream contact surface 226.

An upper right upstream interior surface 232 of the upper right upstream gripping member 230 is proximate to the second grip zone 114 and is beveled upwardly and laterally inwardly from the upper right upstream contact surface 236. Similarly, a lower right upstream interior surface 242 of the lower right upstream gripping member 240 is proximate to the second grip zone 114 and is beveled downwardly and laterally inwardly from the lower right upstream contact surface 246.

Further, an upper left downstream interior surface 406 of the upper left downstream gripping member 404 is proximate to the first grip zone 110 and is beveled upwardly and laterally inwardly from the upper left downstream contact surface 410. A lower left downstream interior surface 422 of the lower left downstream gripping member 420 is proximate to the first grip zone 110, and is beveled downwardly and laterally inwardly from the lower left downstream contact surface 426.

Moreover, an upper right downstream interior surface 432 of the upper right downstream gripping member 430 is proximate to the second grip zone 114 and is beveled upwardly and laterally inwardly from the upper right downstream contact surface 436. A lower right downstream interior surface 442 of the lower right downstream gripping member 440 is proximate to the second grip zone 114 and is beveled downwardly and laterally inwardly from the lower right downstream contact surface 446. Each pair of upper and lower interior surfaces described above are superimposed on a marginal portion of the premium-containing zone, so as to assist in centering the bandolier 102 on the axis of travel 122.

In a preferred embodiment, the apparatus 200 uses opposing sets of treads on endless tracks 203, 207; 205, 209; 403, 407; and 405, 409, as the plurality of gripping pairs. Each track has a plurality of movable treads that are adaptable to move in a downstream direction 124 while in contact with the respective area of the grip zone 110, 114. As above, each tread of each set of tracks is on an endless belt and preferably has a contact surface 210, 226, 236, 246, 410, 426, 436, 446 that engages an area of the respective grip zone 110, 114 and an interior surface 206, 222, 232, 242, 406, 422, 432, 442 proximate to the respective grip zone 110, 114. As used herein, the term "track" is defined to also include belts.

Thus, the upper and lower left upstream treads 204, 220 engage a first area 212 of the first grip zone 110 with upper and lower contact surfaces 210, 226, the upper and lower left downstream treads engage a second area 438 of the first grip zone 110 with upper and lower contact surfaces 410, 426, the upper and lower right upstream treads 230, 240 engage a first area 238 of the second grip zone 114 with upper and lower contact surfaces 236, 246, and the upper and lower right downstream treads 430, 440 engage a second area 412 of the second grip zone 114 with upper and lower contact surfaces 436, 446. Each set of treads clamps only to the respective area of the grip zone but does not clamp the premium-containing zone of the bandolier.

Like their upper right counterparts, the upper left upstream and downstream treads 204, 404 have upper left interior surfaces 206, 406 that are beveled upwardly and laterally inwardly from the contact surfaces 210, 410. The lower left upstream and downstream treads 220, 420 have lower left interior surfaces 222, 422 that are beveled downwardly and laterally inwardly from the contact surfaces 226, 426. The upper right upstream and downstream treads 230, 430 have upper right interior surfaces 232, 432 that are beveled upwardly and laterally inwardly from the contact surfaces 236, 436. The lower right upstream and downstream treads 240, 440 have lower right interior surfaces 242, 442 that are beveled downwardly and laterally inwardly from the contact surfaces 246, 446. The beveled treads, as above, are superimposed on a marginal portion of the premium-containing zone 120 and help center the bandolier 102 on the axis of travel 122.

The controller 252 can be coupled to an optical sensor 260 that is capable of detecting the presence of a packaged premium. The sensor 260 may be a through sensor having a transmitter 260A and a receiver 260B on opposite sides of the packaging. Alternately, the transmitter 260 may be a diffuse sensor where the transmitter and receiver are integrated into a single housing. More preferably, the sensor 260 is movable along a sensor axis 261 that is parallel the axis of travel 122. The sensor axis 261 may be above or below the bandolier 102. Thus, the sensor 260 may be placed anywhere from the infeed of the upstream belts and the outfeed of the downstream belts.

This sensor may be connected to the controller and determine when the upstream tracks start and stop moving. Controller 252 may be programmed to stop and start upstream tracks 203, 205, 207, and 209 as a function of the sensing of packaged premiums 104 (or their absence) by sensor 260. In the event of an obstruction, the sensor may be used with an index delay to stop the package of premiums at a downstream location.

In summary, the above-described embodiments provide apparatus that reduce the stress placed on premium-containing packages. Since the apparatus grips the packaging only by the edges in predetermined grip zones, fragile premiums such as candy and baked goods can be inserted automatically instead of manually, thereby reducing costs and saving time.

While illustrated embodiments of the present invention have been described and illustrated in the appended drawings, the present invention is not limited thereto but only by the scope and spirit of the appended claims.

We claim:

1. Apparatus for separating a packaged premium from a bandolier of packaged premiums, the bandolier comprising a wrapper with weakened separation lines delimiting each packaged premium from adjacent ones of the packaged premiums, a first grip zone along a first longitudinal peripheral edge of the wrapper, a second grip zone of the wrapper along a second longitudinal peripheral edge of the wrapper opposite the first peripheral edge and spaced from the first grip zone by a premium-containing zone, the apparatus comprising:

an upper left upstream endless track disposed along an axis of travel parallel to the first grip zone comprising a plurality of upper left upstream movable treads, each tread having an upper left upstream contact surface for engaging a first area of the first grip zone and being adaptable to move in a downstream direction while in contact with the first area of the first grip zone;

a lower left upstream endless track disposed along the axis of travel comprising a plurality of lower left upstream movable treads, each tread having a lower left upstream contact surface for engaging the first area of the first grip zone against the upper left upstream contact surface but not clamping the premium-containing zone and being adaptable to move in a downstream direction while in contact with the first area of the first grip zone;

an upper left downstream endless track disposed along the axis of travel comprising a plurality of upper left downstream movable treads, each tread having an upper left downstream contact surface for engaging a second area of the first grip zone and being adaptable to move in a downstream direction while in contact with the second area of the first grip zone;

a lower left downstream endless track disposed along the axis of travel comprising a plurality of lower left downstream movable treads, each tread having a lower left downstream contact surface for engaging the second area of the first grip zone against the upper left downstream contact surface but not clamping the premium-containing zone and being adaptable to move in a downstream direction while in contact with the second area of the first grip zone;

an upper right downstream endless track disposed along the axis of travel of a plurality of upper right downstream movable treads, each tread having an upper right downstream contact surface for engaging a first area of the second grip zone and being adaptable to move in a downstream direction while in contact with the first area of the second grip zone;

a lower right downstream endless track disposed along the axis of travel comprising a plurality of lower right downstream movable treads, each tread having a lower right downstream contact surface for engaging the first area of the second grip zone against the upper right downstream contact surface but not clamping the premium-containing zone and being adaptable to move in a downstream direction while in contact with the first area of the second grip zone;

an upper right upstream endless track disposed along the axis of travel comprising a plurality of upper right upstream movable treads, each tread having an upper right upstream contact surface for engaging a second area of the second grip zone and being adaptable to move in a downstream direction while in contact with the second grip zone;

a lower right upstream endless track disposed along the axis of travel comprising a plurality of lower right upstream movable treads, each tread having a lower right upstream contact surface for engaging the second area of the second grip zone against the upper right upstream contact surface but not clamping the premium-containing zone and being adaptable to move in a downstream direction while in contact with the second area of the second grip zone;

a first drive mechanism coupled to at least one of the upper left upstream endless track and the lower left upstream endless track, coupled to one of the upper right upstream endless track and the lower right upstream endless track, and selectively actuable to translate the treads in a downstream direction parallel to the axis of travel;

a second drive mechanism coupled to at least one of the upper left downstream endless track and the lower left downstream endless track, coupled to one of the upper right downstream endless track and the lower right downstream endless track, and translating the treads in a downstream direction parallel to the axis of travel, the speed of the upstream tracks being at least intermittently different from the speed of the downstream tracks so as to separate the first packaged premium from the bandolier;

an upper left upstream interior surface of the upper left upstream track proximate to the first grip zone, the upper left upstream interior surface being beveled upwardly and laterally inwardly from the upper left upstream contact surface;

a lower left upstream interior surface of the lower left upstream track proximate to the first grip zone, the lower left upstream interior surface being beveled downwardly and laterally inwardly from the lower left upstream contact surface;

an upper left downstream interior surface of the upper left downstream track proximate to the first grip zone, the upper left downstream interior surface being beveled upwardly and laterally inwardly from the upper left downstream contact surface;

a lower left downstream interior surface of the lower left downstream track proximate to the first grip zone, the lower left downstream interior surface being beveled downwardly and laterally inwardly from the lower left downstream contact surface;

an upper right upstream interior surface of the upper right upstream track proximate to the second grip zone, the upper right upstream interior surface being beveled upwardly and laterally inwardly from the upper right upstream contact surface;

a lower right upstream interior surface of the lower right upstream track proximate to the second grip zone, the lower right upstream interior surface being beveled downwardly and laterally inwardly from the lower right upstream contact surface;

an upper right downstream interior surface of the upper right downstream track proximate to the second grip zone, the upper right downstream interior surface being beveled upwardly and laterally inwardly from the upper right downstream contact surface; and a lower right downstream interior surface of the lower right downstream track proximate to the second grip zone, the lower right downstream interior surface being beveled downwardly and laterally inwardly from the lower right downstream contact surface;

wherein the upper and lower interior surfaces are superimposed on a marginal portion of the premium-containing zone, so as to assist in centering the bandolier on the axis of travel.

2. The apparatus of claim 1, wherein the separation is a gradual tearing from the first longitudinal edge and the second longitudinal edge towards the center of the weakened separation line.

3. The apparatus of claim 1, wherein the left upstream endless tracks and the right upstream endless tracks are spaced apart by a first space and the left downstream endless tracks and the right downstream endless tracks are spaced apart by a second space, each space being laterally adjustable in a direction orthogonal to the axis of travel, such that the upstream and downstream endless tracks can accommodate bandoliers having a range of widths.

4. The apparatus of claim 1, further comprising a controller coupled to the first and second drive mechanisms and being adapted to halt the first drive mechanism while the second drive mechanism continues to translate the downstream endless tracks in a downstream direction, causing a gradual tearing from the first longitudinal edge and the second longitudinal edge towards the center of the weakened separation line thereby separating the first packaged premium from the bandolier.

5. The apparatus of claim 1, further comprising a controller coupled to the first and second drive mechanisms and being adapted to actuate the first drive mechanism at a first speed and the second drive mechanism at a second speed, the first speed being faster than the second speed.

6. The apparatus of claim 1, further comprising a sensor having a transmitter and a receiver.

7. The apparatus of claim 6, wherein the sensor is a diffuse sensor.

8. The apparatus of claim 6, the sensor being movable along a sensor axis that is parallel to the axis of travel.

* * * * *